US007516988B2

(12) United States Patent
Lin

(10) Patent No.: US 7,516,988 B2
(45) Date of Patent: Apr. 14, 2009

(54) TELESCOPIC COUPLING TUBE FOR A VACUUM CLEANER

(75) Inventor: Chia Ming Lin, Tali (TW)

(73) Assignee: Kinergy Industrial Co., Ltd., Taichung (TW)

( * ) Notice: Subject to any disclaimer, the term of this patent is extended or adjusted under 35 U.S.C. 154(b) by 66 days.

(21) Appl. No.: 11/803,372

(22) Filed: May 15, 2007

(65) Prior Publication Data

US 2008/0284158 A1 Nov. 20, 2008

(51) Int. Cl.
*A47L 9/24* (2006.01)

(52) U.S. Cl. ..... 285/7; 285/302; 285/303; 15/414

(58) Field of Classification Search ..... 285/7, 285/302, 303; 15/414
See application file for complete search history.

(56) References Cited

U.S. PATENT DOCUMENTS 5,332,266 A * 7/1994 Canale ..... 285/7
6,148,474 A * 11/2000 Ohara et al. ..... 15/377
6,431,607 B1 * 8/2002 Kittelmann et al. ..... 285/7
6,474,696 B1 * 11/2002 Canale ..... 285/7
6,494,492 B1 * 12/2002 Ha ..... 285/7
6,513,191 B1 * 2/2003 Kim ..... 15/414
6,565,123 B2 * 5/2003 Schiemann et al. ..... 285/7
6,612,617 B2 * 9/2003 Xu ..... 285/7
6,634,674 B1 * 10/2003 Xu ..... 285/7
6,702,332 B2 * 3/2004 Young et al. ..... 285/7
6,832,784 B1 * 12/2004 Chen ..... 285/7
7,025,383 B2 * 4/2006 Canale ..... 285/7

* cited by examiner

*Primary Examiner*—David E Bochna
(74) *Attorney, Agent, or Firm*—Troxell Law Office, PLLC

(57) ABSTRACT

A telescopic coupling tube for a vacuum cleaner including a mounting tube, a telescopic tube, a locking assembly, a positioning socket, and a sealing socket. The mounting tube serves for insertion of the telescopic tube. A simple adjustment of the assembly length is ensured by means of the locking assembly and the sealing socket in match of the corresponding locking grooves in the wall of the telescopic tube.

1 Claim, 3 Drawing Sheets

TELESCOPIC COUPLING TUBE FOR A VACUUM CLEANER

BACKGROUND OF THE INVENTION

1. Fields of the Invention

The present invention relates to a telescopic coupling tube for a vacuum cleaner, and more particularly to a structure that ensures an easy adjustment of the assembly length for meeting different user requirements.

2. Description of the Related Art

The conventional vacuum cleaner (not shown) normally includes a plurality of expansion tubes and different kinds of suction heads that are engaged into the rear end surface of the body of the vacuum cleaner. In this way, they can be employed in accordance with user requirements. The plug-type connection belongs to the prior art so that no further descriptions thereto are given hereinafter. The invention relates to an extension coupling tube for a vacuum cleaner.

As well-known in the art, the conventional extension coupling tube for a vacuum cleaner has a fixed length. It's not possible for further extension if required. In other words, the user has no other way for extension even when the length is not sufficient. As a result, this structure requires further improvements.

SUMMARY OF THE INVENTION

It is a primary object of the invention to provide a telescopic coupling tube for a vacuum cleaner that meets the actual requirement of the users and permits an expected convenience and practicalness.

According to the invention, the assembly length of a mounting tube and a telescopic tube is freely adjustable by a simple action of a locking assembly. In addition to meeting the user requirements, the original accommodating effect won't be affected.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
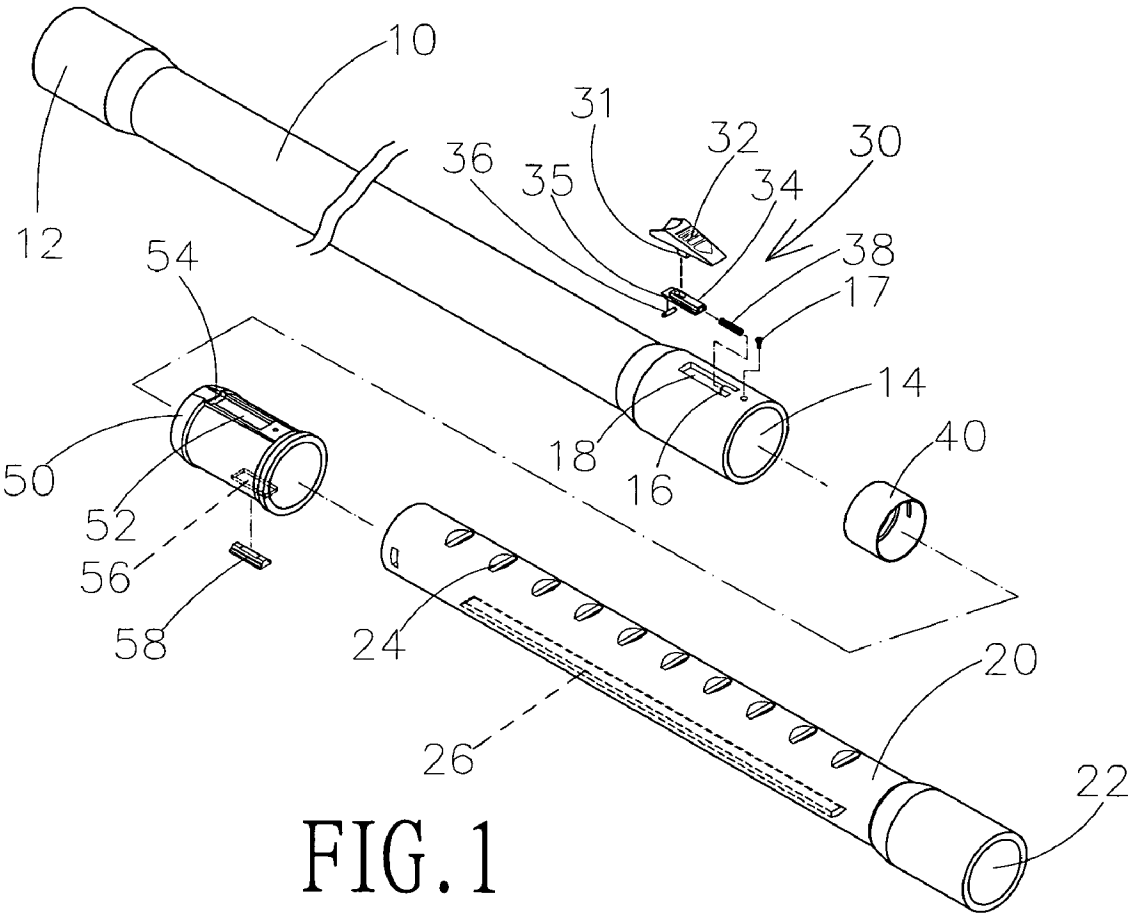
FIG. 1 is a perspective assembly view of the invention.
Figure 2:
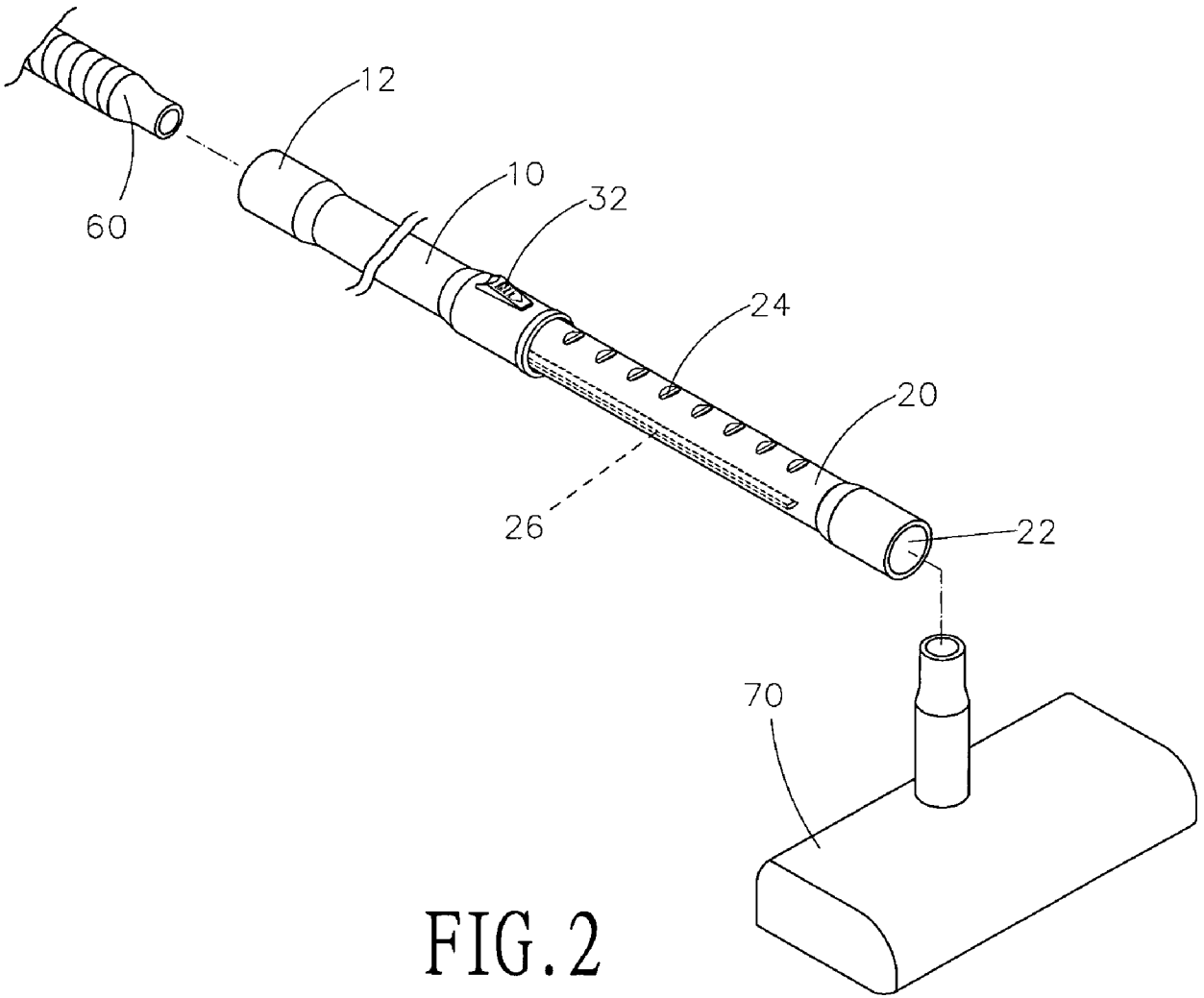
FIG. 2 is an exploded perspective view of the invention.

As shown in FIGS. 1 and 2, a telescopic coupling tube for a vacuum cleaner in accordance with the invention includes a mounting tube 10, a telescopic tube 20, a locking assembly 30, a positioning socket 40, and a sealing socket 50.

The mounting tube 10 has a first insertion portion 12 for a dust pick-up hose 60 at one end thereof and a second insertion portion 14 for the telescopic tube 20 at the other end thereof. A slot 18 with a lug 16 is formed in the second insertion portion 14.

The telescopic tube 20 has a positioning socket 40 mounting on one end thereof for preventing an unexpected loosening from the mounting tube 10 and an insertion opening 22 for a suction head 70 at the other end thereof. A plurality of locking grooves 24 corresponding to the locking assembly 30 are axially formed in the telescopic tube 20. A recessed guide rail 26 is formed in the opposing bottom surface.

The locking assembly 30 consists of a push bottom 32, a fastening element 34, a locking element 36, and a spring 38. The push bottom 32 includes a projection 31 at the bottom thereof that fits into the fastening element 34 such that the push bottom 32 and the projection 31 are joined within the slot 18 of the mounting tube 10. The fastening element 34 is located just in a slide slot 52 of the sealing socket 50. A guide inclination 35 is formed at the rear side of the bottom of the fastening element 34. Moreover, the spring 38 is mounted on the lug 16 in the slot 18 of the mounting tube 10 while the other end of the spring 38 is pushed against the fastening element 34. The locking element 36 is received within the elongated through hole 54 at one side of the slide slot 52 of the sealing socket 50.

The positioning socket 40 is fixed at the rear end of the telescopic tube 20.

The sealing socket 50 is inserted into the front end of the mounting tube 10 and fixed by a screw element 17 in place. A slide slot 52 is formed at a place corresponding to the slot 18 of the mounting tube 10. Meanwhile, an elongated through hole 54 is formed at the rear end of the slide slot 52. An elongated slot 56 is formed at a place corresponding to the recessed guide rail 26 of the telescopic tube 20 for receiving a positioning element 58 to restrict the telescopic movement of the telescopic tube 20.

Figure 3:
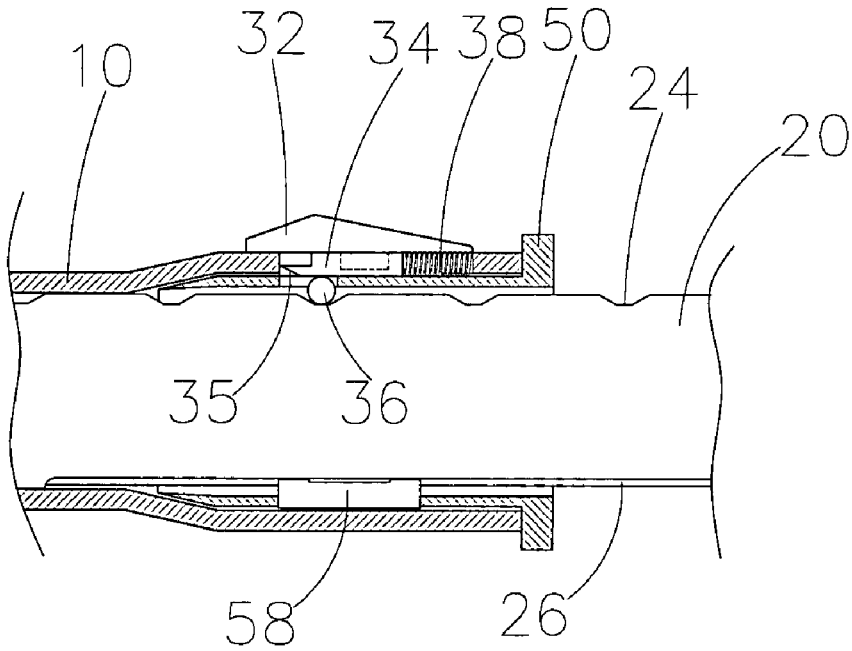
FIG. 3 is a partial sectional view side of the invention.
Figure 4:
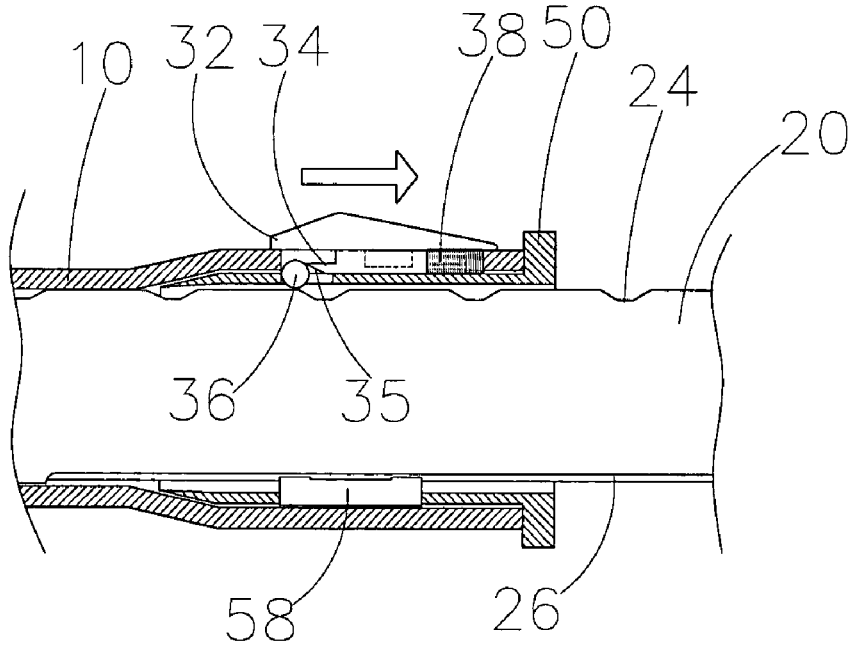
FIG. 4 is a partial sectional view side of the invention, showing the operation way thereof.

In the ordinary state, the spring 38 creates a continuous backward pushing force such that the locking element 36 is compressed downward and locked at a place between any one of the locking grooves 24 and the bottom surface of the fastening element 34 (see FIGS. 3 and 4). As a result, an automatic locking effect is ensured. Thereafter, the push bottom 32 is pushed forward such that the locking element 36 is moved upward along the guide inclination 35 of the fastening element 34 in a released position. Accordingly, the use only requires a slight push to the push bottom 32 for adjusting the telescopic tube 20 to a desired length. A free adjustment of the assembly length is therefore achieved when the push bottom 32 is released.

Moreover, the top of the positioning element 58 is constantly extended into the recessed guide rail 26 of the telescopic tube 20. Therefore, an automatic restriction of the telescopic action is ensured when the positioning element 58 arrives at the end of both sides of the recessed guide rail 26.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. A telescopic coupling tube for a vacuum cleaner, comprising:

a) a mounting tube having a first insertion portion for a dust pick-up hose at one end thereof and a second insertion portion for the telescopic tube at the other end thereof, a slot with a lug being formed in the second insertion portion;

b) a telescopic tube having a positioning socket mounting on a rear end thereof for preventing an unexpected loosening from the mounting tube and an insertion opening for a suction head at the other end thereof, a plurality of locking grooves corresponding to the locking assembly being axially formed in the telescopic tube, a recessed guide rail being formed in the opposing bottom surface;

c) a locking assembly consisting of a push bottom, a fastening element, a locking element, and a spring, the push bottom having a projection at the bottom thereof that fits into the fastening element such that the push bottom and the projection are joined within the slot of the mounting tube, the fastening element being located just in a slide slot of a sealing socket, a guide inclination being formed at the rear side of the bottom of the fastening element, the spring being mounted on the lug in the slot of the mounting tube while the other end of the spring is pushed against the fastening element, the locking element being received within an elongated through hole at one side of the slide slot of the sealing socket; and d) a sealing socket inserted into the front end of the mounting tube and fixed by a screw element in place, the slide slot being formed at a place corresponding to the slot of the mounting tube, an elongated through hole being formed at the rear end of the slide slot, an elongated slot being formed at a place corresponding to the recessed guide rail of the telescopic tube for receiving a positioning element to restrict the telescopic movement of the telescopic tube, wherein, in the ordinary state, the spring creates a continuous backward pushing force such that the locking element is compressed downward and locked at a place between any one of the locking grooves and the bottom surface of the fastening element, thereby achieving an automatic locking effect; and wherein the push bottom is pushed forward such that the locking element is moved upward along the guide inclination of the fastening element in a released position.

* * * * *